US005345759A

United States Patent [19]

Awon

[11] Patent Number: 5,345,759

[45] Date of Patent: Sep. 13, 1994

[54] INTERNAL COMBUSTION AND INTERNALLY COOLED STEAM ENGINE AND POWERING METHOD

[76] Inventor: Maxwell P. Awon, 1 Alexandra Street, St. Clair, Port of Spain, Trinidad and Tobago

[21] Appl. No.: 836,235

[22] Filed: Feb. 18, 1992

[51] Int. Cl.[5] ..... F02C 7/00

[52] U.S. Cl. ..... 60/39.53; 60/39.59

[58] Field of Search ..... 60/39.05, 39.53, 39.58, 60/39.59

[56] References Cited

U.S. PATENT DOCUMENTS

| | | | |
|---|---|---|---|
| 601,456 | 3/1898 | Woillard | 60/39.59 |
| 1,209,211 | 12/1916 | Sands | 60/39.59 |
| 1,243,812 | 10/1917 | Clutter | 60/39.58 |
| 1,324,607 | 12/1919 | Maclean | 60/39.59 |
| 1,372,121 | 3/1921 | Davis | 60/39.59 |
| 1,594,953 | 8/1926 | Herzog | 60/39.53 |
| 2,299,849 | 10/1942 | Rees | 60/39.59 |
| 4,121,422 | 10/1978 | Flinn | 60/597 |

FOREIGN PATENT DOCUMENTS

| | | | |
|---|---|---|---|
| 0028850 | of 1907 | United Kingdom | 60/39.59 |

*Primary Examiner*—Richard A. Bertsch
*Assistant Examiner*—Michael I. Kocharov
*Attorney, Agent, or Firm*—Malloy & Malloy

[57] ABSTRACT

An internal combustion and internally cooled steam engine and powering method to be used to more efficiently and effectively power steam turbines and like drive sources. The steam engine includes an insulated pressure chamber having a boiler concentrically located therein, and a combustion chamber concentrically positioned within the boiler, into which fuel and air pass, through inlet conduits, and are ignited to form hot gasses, thereby heating water within the boiler such that steam emerges from the boiler through a plurality of apertures in the boiler and mixes with the hot gasses. The gasses emerge into the pressure chamber through at least one flue gas line connected to the combustion chamber, and extending into the pressure chamber. The flue gas line includes a plurality of holes therein to enable the hot gasses to escape and mix with the steam, thereby super heating the steam for subsequent driving of a steam turbine connected to the pressure chamber, and having a filter to remove sulfur oxides positioned therebetween.

12 Claims, 1 Drawing Sheet

INTERNAL COMBUSTION AND INTERNALLY COOLED STEAM ENGINE AND POWERING METHOD

BACKGROUND OF THE INVENTION

1. Field of the Invention

This invention relates to an internal combustion and internally cooled steam engine and powering method to be used as a fuel efficient and environmentally friendly means of powering steam turbines and like drive assemblies.

2. Description of the Prior Art

A commonly sought after goal of engine powering systems is to maximize the amount of work that can be performed by a minimal amount of fuel. Additionally, it is desirous to minimize pollutants generated by these engines. For these reasons, others in the past have attempted to develop hybrid engines that combine fuel combustion and steam powering. In U.S. Pat. No. 4,300,353 to Ridgway, and U.S. Pat. No. 4,509,464 to Hansen, complex systems were developed to combine fuel combustion and steam powering. These engines however, include separate steam generating and fuel combusting operations, and combine their finished product to power the system. Other systems as that of Hallstrom, Jr., U.S. Pat. No. 4,433,548, utilize extra energy from a first operation to provide energy for a second power stroke, thereby providing two strokes of average power. Finally, engines such as those devised by Thomas, U.S. Pat. No. 4,417,447 and Thomas, U.S. Pat. No. 4,783,963, inject water into individual heated power cylinders which serve as a steam boiler which provide steam for the power stroke. None of these designs, however, provide a singularly contained unit which through a single combustion process heats separately contained fuel and water, and combines the formed steam and the heated gasses formed by the fuel combustion to provide a single high-powered, easily filtered means of driving a turbine.

Applicant's invention is devised specifically to utilize a single efficient process which combines all the by-products gasses of fuel combustion, most of which would normally be wasted in ordinary combustion processes, with the steam produced from the same initial combustion of fuel and air, and thereby provide an easily filtered super heated means of powering a turbine.

SUMMARY OF THE INVENTION

The present invention relates to an internal combustion and internally cooled steam engine and powering method to be used as a fuel maximizing and environmentally friendly means of powering a steam turbine. The steam engine includes a pressure chamber containing a boiler concentrically positioned therein. The boiler which includes water inlet means, is used to contain water to be heated and includes a plurality of steam outlet apertures such that steam may escape from the boiler and into the pressure chamber. Concentrically positioned within the boiler is a combustion chamber. The combustion chamber includes air and fuel inlet means to enable a mixture of air and fuel to be sprayed therein where they may be ignited to form hot gasses and to heat the water within the boiler. Connected to the combustion chamber is at least one flue gas line which extends from the combustion chamber into the pressure chamber. The flue gas line includes a plurality of holes therein such that hot gasses emerging from the combustion chamber may escape therethrough and mix with the steam in the pressure chamber. The hot gasses and now super heated steam within the pressure chamber is then directed towards means connected to the pressure chamber, thereby resulting in the driving of a steam turbine.

It is an object of the present invention to maximize the fuel used by utilizing it to heat water as well as utilizing the hot gasses formed from the fuel to super heat the steam and assist in driving the steam turbine.

It is another object of the present invention to provide a steam engine which is cost effective to construct and can perform equivalent amounts of work as a larger steam engine.

It is yet another object of the present invention to drive a steam turbine while producing minimum amounts of soot and smoke, and allowing that sulfur oxides formed may be easily filtered such that they do not escape into the environment.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
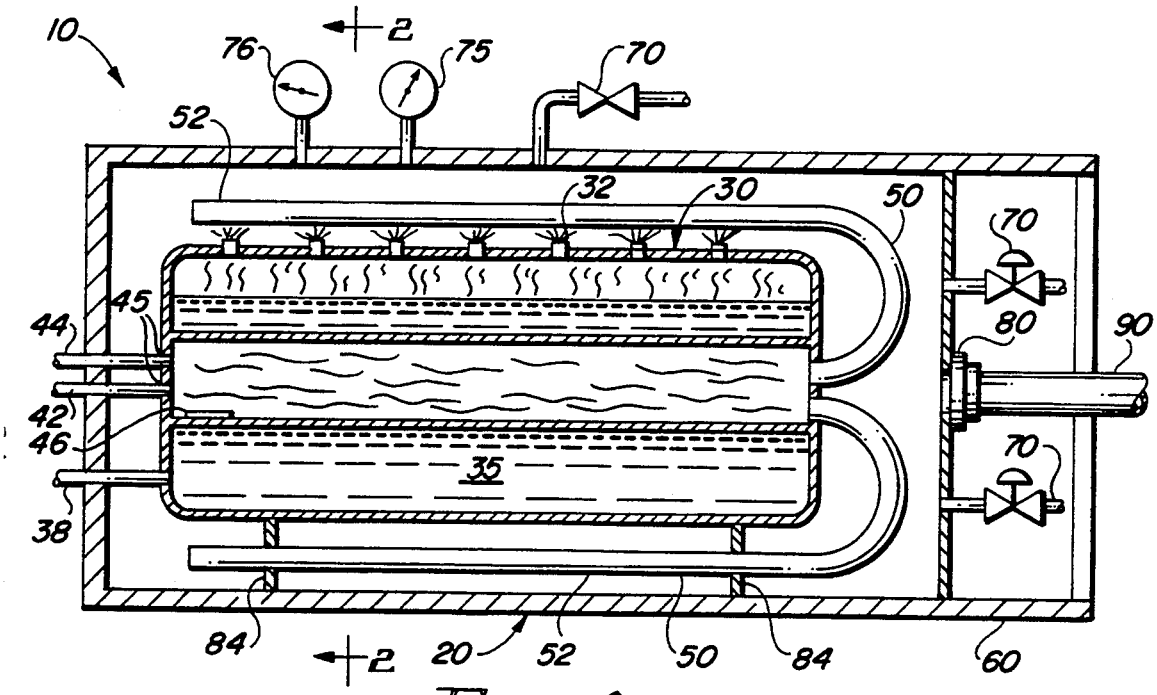
FIG. 1 is a cross-sectional side view of the internal combustion and internally cooled steam engine.
Figure 2:
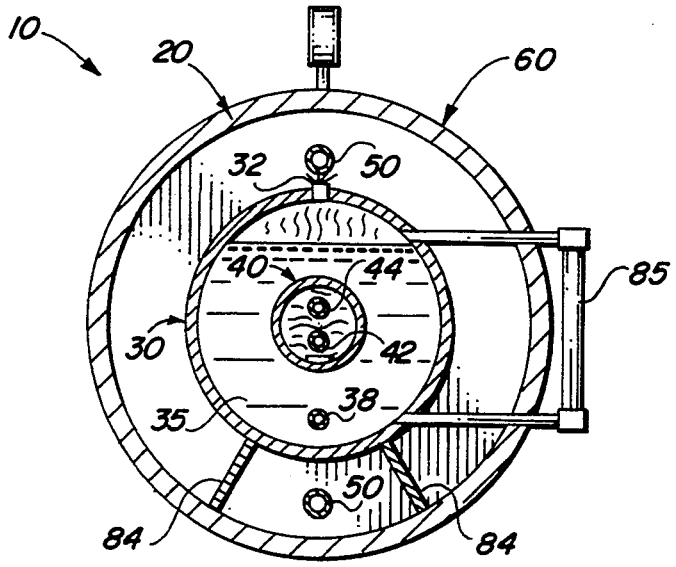
FIG. 2 is a cross-sectional front view along line 2—2 of FIG. 1.

As detailed throughout FIGS. 1 and 2, the present invention is directed towards an internal combustion and internally cooled steam engine generally indicated as 10. The steam engine 10 includes primarily a pressure chamber 20 wherein a boiler 30 is concentrically positioned atop support legs 84. Concentrically located within the boiler 30 is a combustion chamber 40 wherein air and fuel are ignited. The air and fuel are sprayed into the combustion chamber 40 from an air inlet conduit 42 and a fuel inlet conduit 44 which pass through the pressure chamber 20 and are connected to the combustion chamber 40. The air inlet conduit 42 and fuel inlet conduit 44 further include atomizers 45 at an end thereof such that the fuel and air will be sprayed into the combustion chamber 40. The fuel and air within the combustion chamber 40 are ignited using an ignitor 46, and cause water 35 within the boiler 30 to boil and turn to steam. The steam emerges from the boiler 30 and into the pressure chamber 20 by means of a plurality of steam outlet apertures 32 located atop the boiler 30. Additionally, hot gasses formed by igniting the fuel and air within the combustion chamber 40 pass through a pair of flue gas lines 50 which are connected to the combustion chamber 40 and extend into the pressure chamber 20. Each of the flue gas lines 50 includes a plurality of holes 52 such that the hot gasses may pass into the pressure chamber 20 and mix with the steam, thereby super heating the steam. The hot gas and super heated steam may then be filtered to remove sulfur oxides therefrom by a filtration device 80, and function to power a turbine 90 connected to the pressure chamber 20. In order to further increase the efficiency of the engine 10, the filter 80 is placed in a conduit to the turbine 90, all of which are recessed within the pressure chamber. Located about the periphery of the pressure chamber 20 are a plurality of pressure release valves 70. Additionally, a temperature gauge 75 and pressure gauge 76 are connected to the pressure chamber 20 to measure the conditions therein.

In order to minimize the heat loss of the steam engine 10, the pressure chamber 20 is surrounded by a layer of insulation 60. Further, in order to maintain a constant water level which enters the boiler 30 through a water inlet conduit 38, a water level gauge 85, best seen in FIG. 2, passes through the pressure chamber 20 and is connected to the boiler 30.

The engine 10 can be used to produce steam mixed with flue gasses, and with slight modification, steam without flue gasses. Accordingly, it can be used as a water heater, distillation device, or steam generator. All of these devices would incorporate the same principal of having the combustion chamber 40 below the surface of the fluid.

What is claimed is:

1. An internal combustion and internally cooled steam engine comprising:

a pressure chamber and a boiler, said boiler being concentrically positioned within said pressure chamber and including fluid inlet means, said boiler further including a plurality of steam outlet apertures, a combustion chamber concentrically positioned within said boiler, said combustion chamber including air and fuel inlet means therein and being structured and disposed such that air and fuel combusted within said combustion chamber will heat fluid in said boiler so as to form steam which exits said boiler into said pressure chamber through said steam outlet apertures, at least one flue gas line connected to and extending from said combustion chamber into said pressure chamber and being structured and disposed to receive hot gasses formed by the combustion of the air and fuel in said combustion chamber, and said flue gas line being substantially disposed within said pressure chamber such that said hot gasses therein super heat said steam in said pressure chamber.

2. A steam engine as recited in claim 1 wherein said flue gas line includes a plurality of holes therein such that said hot gasses formed by said air and fuel combustion within said combustion chamber and emerging therefrom may escape through said holes and mix with said steam in said pressure chamber.

3. A steam engine as recited in claim 2 wherein said pressure chamber includes a plurality of adjustable pressure reduction valves.

4. A steam engine as recited in claim 3 wherein said pressure chamber includes a pressure gauge and a temperature gauge attached thereto to measure the conditions within said pressure chamber.

5. A steam engine as recited in claim 4 wherein said water inlet means includes an elongate conduit passing through said pressure chamber and into said boiler.

6. A steam engine as recited in claim 5 wherein said air and fuel inlet means includes a pair of elongate conduits passing through said pressure chamber and into said combustion chamber.

7. A steam engine as recited in claim 6 wherein said air conduit and fuel conduit each include an atomizer at an end thereof to spray the air and fuel into said combustion chamber.

8. A steam engine as recited in claim 7 wherein said combustion chamber includes an ignitor to begin combustion with said combustion chamber.

9. A steam engine as recited in claim 8 wherein a filtration device is included at a connection between said pressure chamber and said drive means such that sulfur oxide is filtered out from the hot gases and said super heated steam.

10. A steam engine as recited in claim 8 further including drive means connected to said pressure chamber and being structured and disposed for driven operation by said hot gasses and said super heated steam directed from said pressure chamber.

11. A steam engine as recited in claim 1 wherein said drive means includes a steam turbine assembly drivingly interconnected with a main drive shaft.

12. A steam engine as recited in claim 11 wherein said pressure chamber is surrounded by a layer of insulative material.

* * * * *